US008893894B2

(12) United States Patent
Steadman et al.

(10) Patent No.: US 8,893,894 B2
(45) Date of Patent: Nov. 25, 2014

(54) WIRE SCREEN WITH FLATTENED WIRE

(71) Applicant: Buffalo Wire Works, Buffalo, NY (US)

(72) Inventors: Erich Steadman, Williamsville, NY (US); Dominic Nasso, East Amherst, NY (US); Sagar Chaudhari, Tonawanda, NY (US)

(73) Assignee: Buffalo Wire Works, Buffalo, NY (US)

( * ) Notice: Subject to any disclaimer, the term of this patent is extended or adjusted under 35 U.S.C. 154(b) by 0 days.

(21) Appl. No.: 14/054,240

(22) Filed: Oct. 15, 2013

(65) Prior Publication Data

US 2014/0102953 A1 Apr. 17, 2014

Related U.S. Application Data

(60) Provisional application No. 61/713,489, filed on Oct. 13, 2012.

(51) Int. Cl.
*B07B 1/49* (2006.01)
*B07B 1/46* (2006.01)

(52) U.S. Cl.
CPC ..... *B07B 1/4672* (2013.01); *B07B 1/4618* (2013.01)
USPC ..... 209/409; 209/397; 209/399; 209/400; 209/403

(58) Field of Classification Search
USPC ..... 209/397, 399, 403, 405, 409
See application file for complete search history.

(56) References Cited

U.S. PATENT DOCUMENTS 2,061,850 A 11/1936 Roberts
2,257,993 A * 10/1941 Young ..... 140/7
2,895,535 A 7/1959 Ono
3,252,263 A 5/1966 Korf
3,459,615 A 8/1969 Eilerman
3,632,463 A 1/1972 McFarlane
4,120,785 A 10/1978 Kanamori et al.
4,247,007 A 1/1981 Kai
4,295,918 A 10/1981 Benson et al.
4,819,809 A 4/1989 Derrick
4,857,176 A 8/1989 Derrick et al.
5,332,462 A 7/1994 Myers
5,417,793 A 5/1995 Bakula
6,269,953 B1 8/2001 Seyffert et al.
6,305,549 B1 10/2001 Riddle et al.
6,450,345 B1 9/2002 Adams et al.

(Continued)

OTHER PUBLICATIONS

Hoyt Wire Cloth advertisement for Serpa XLT vibratory screen, 3 pages, available before Oct. 2012.

*Primary Examiner* — Terrell Matthews
(74) *Attorney, Agent, or Firm* — Roach Brown McCarthy & Gruber, P.C.; Kevin D. McCarthy

(57) ABSTRACT

A screen has a plurality of flattened wires. The wires are arranged longitudinally in a first direction, and of those wires there are first and second flattened wires are spaced a predetermined distance from each other or contact or appear to contact each other at spaced intervals to form a polygonic spacing to form a desired screen spacing. The deviation from the desired screen spacing is equal to or less than the standard industry tolerance as established by ASTM E2016-11, table 8. A first and second polymeric support member homogenously encase, respectively, a first and second limited selected portions of the plurality of flattened wires spaced apart. There is no additional metal material in, within, or on the first or second polymeric support members, and the desired screen spacing is maintained even when the first and second polymeric support members are applied and cured.

21 Claims, 15 Drawing Sheets

(56) References Cited

U.S. PATENT DOCUMENTS

| | | | | |
|---|---|---|---|---|
| 7,306,022 | B2 | 12/2007 | Hughes et al. | |
| 7,581,569 | B2 * | 9/2009 | Beck | 139/425 R |
| 8,353,407 | B2 | 1/2013 | Steadman | |
| 2004/0103979 | A1 | 6/2004 | Kramer | |
| 2004/0251175 | A1 | 12/2004 | Adams et al. | |
| 2007/0125687 | A1 * | 6/2007 | Kutryk | 209/397 |

* cited by examiner

WIRE SCREEN WITH FLATTENED WIRE

CROSS-REFERENCE TO RELATED APPLICATIONS

This application claims priority to U.S. provisional patent application Ser. No. 61/713,489, filed on Oct. 13, 2012.

FIELD OF THE INVENTION

The invention relates to an apparatus and method for making wire screens, particularly self-cleaning wire screens.

BACKGROUND OF THE INVENTION

Machines to separate differently sized particles, such as aggregate shakers, sifters, or vibrating screeners are well known in the art, particularly for construction, industrial, and other related applications. These machines include vibrating decks which receive wire screens for separating larger sized particles from smaller sized particles, by shaking loads of aggregate, rocks, dirt, and related material through one or more screens. The screens may have openings arranged to sort particle sizes from a fraction of an inch to several inches, as needed. A single shaker may include a plurality of generally vertically stacked screens for simultaneously separating multiple sizes from the same load of material. Due to the harsh conditions under which the screens are used, the screens have to be replaced regularly. Traditional screens generally comprise two sets of round wires woven perpendicularly together.

To increase the lifespan and decrease the required maintenance of wire screens, self-cleaning screens are also now commonly used. The self-cleaning screens generally include wires which extend in a single longitudinal direction, with a support means to hold the wires in alignment. Thus, each wire can vibrate at its own frequency and the wires can separate from each other, so that rocks or debris will be shaken loose from the screen and the screen will not easily peg or blind. That is, due to the individually vibrating wires, self-cleaning screens do not experience the same level of pegging or blinding as do traditional woven screens.

The support means for some self-cleaning screens comprise small groups of perpendicularly woven wires, which act to support the screen at intervals along the screen. However, the metal-on-metal contact caused by the woven wires increases wear on the screen at the woven sections and decreases the lifespan of the screens. To increase the flexibility and lifespan of the screens, other self-cleaning screens may include a strip of a polymer material formed about and around the groups of perpendicularly woven wires. The polymer support strips are generally made by placing two preformed polymer bars or strips, one above the wires and one below, and then welding them together by heating the bars. Although this fuses the two bars together, support members made in this way still suffer from delamination or general weakness at the interface where the two bars are welded together. Even when polymer support strips are used, the perpendicularly woven wires are often required to first also be included, so that the woven wires hold the longitudinal wires of the screen in the final configuration while the polymer strips are formed. Screens which include both a polymer strip and perpendicularly woven wires require additional time, material, and cost to manufacture than traditional screens and inherently have greater variation in spacings between the wires due to gaps between the warp wires that are required for pre-weaving to receive the weft wires. Without the pre-weaving, some other means would be required to at least temporarily hold the wires in the screen's final configuration.

As a result, self-cleaning screens are desired that include the benefits of polymer support members, but not the shortcomings of woven perpendicular wires, and which take less time, material, and cost to manufacture than screens which include both woven wires and polymer support strips. Accordingly, self-cleaning wires would have desired spacings to prevent those problems. Thus, what is, needed a method an apparatus for creating a self-cleaning screen which includes polymer support means and which does not require pre-weaving of other wires, and does not require pre-formed polymer bars or strips.

Conventional wire screens have an obvious trade off wherein increasing opening area requires decreasing diameter of wire and therefore decreases the screen's life. For example, round wires are unable to achieve significant (a) additional through put by providing additional open area and (b) increase of the screen's life. Specifically, increasing the open area of a screen has previously resulted in additional through put that is approximately equal to the increase in the open area. For example, if the open area is increased by 3% then the additional through put previously achieved would be approximately 3%. This is undesirable as the efficiency of conventional screens is limited in that the percentage of additional through put is limited to approximately the same decrease in screen life by approximately the same amount.

Further, previously known screens with wires having a cross-sectional height greater than the cross-sectional width have experienced some upward movement because the the wires were not able to vibrate enough to eliminate or dramatically reduce upward movement of particles. This is undesirable as it can significantly reduce the efficiency of the woven wire screen.

To solve that problem, Hoyt Wire Cloth manufactures a Serpa XLT vibratory screen that abides to the teachings in U.S. Pat. No. 7,581,569. That screen has a woven wire cloth extending in a substantially flat plane. The woven wire cloth has a plurality of warp wires and a plurality of weft wires. Each of the warp wires and each of the weft wires have a cross-sectional height extending substantially perpendicular to the plane of the woven wire cloth and a cross-sectional width extending substantially parallel to the plane of the woven wire cloth. The warp wires are arranged substantially parallel to each other, disposed completely in a common horizontal plane limited by a dimension of the cross-sectional height of the warp wire, and defining openings in the woven wire cloth for the passage of material there through. The weft wires extend substantially perpendicular to the warp wires, the weft wires being woven through the warp wires in groups at spaced intervals. The Serpa XLT screen utilizes round wire that is compressed and formed into an "oblong" configuration design. These crimped "oblong" wires are then woven to create the Serpa XLT screen.

The prior art weaves the weft and warp wires together first and then, optionally, overcoats the wires to protect the weft wires. The overcoat is not used to set the position of the warp wires, instead the overcoat layer is used to protect the weft wires. Moreover, the warp wires are merely overcoated by a polymeric material. Those significant facts are confirmed in U.S. Pat. No. 7,581,569 wherein it was expressed, "the weft wires . . . are disposed substantially in a common plane and are arranged substantially parallel to each other. The weft wires . . . extend substantially perpendicular to the warp wires . . . . The weft wires . . . are woven through the warp wires . . . in groups . . . that are arranged at spaced intervals. The number of the groups . . . of the weft wires . . . and the number of weft wires . . . in each of the groups . . . may vary depending on dimensions and desired configuration of the woven wire cloth . . . . The weft wires . . . may be woven through the warp wires . . . , for example, by a double or triple heddle loom. The weft wires . . . maintain the warp wires . . . in spaced relation to each other. Alternatively or in addition to the weft wires . . . , the warp wires . . . may be maintained in spaced relation to each other by molding the warp wires . . . together at spaced intervals. The warp wires . . . may be molded together, for example, with a polyurethane or rubber material." (see col. 3, lines 1 to 16) and as illustrated at Hoyt's Serpa XLT™ Screens brochure (which is being provided in an information disclosure statement) wherein the orange polymeric material, illustrated at the bottom of the first page, overcoats the the warp wires where the weft wires exist. Overcoating warp wires, without weft wires, is impractical for Hoyt's Serpa XLT™ Screens because the warp wires will not retain their spaced relationship to each other without the weft wires; in addition Hoyt only manufactures screens with both warp and weft wires, and sometimes with a polymeric overcoat over the warp wires where the weft wires are positioned. Based on Hoyt's vague teaching in the '569 patent—fails to disclose any polymeric material in the figures and baldly asserts an alternative embodiment without any disclosing how to implement it—and how Hoyt actually applies the polymeric material in its Serpa XLT™ Screens, one understands and appreciates that weft and warp wires are required in screens with an optional polymeric overcoat layer to inhibit pitting from occurring at the junction of the weft and warp wires.

In the formation of the Serpa XLT Screens, the warp wires, prior to being overcoated have gaps (which Hoyt identifies as spacing intervals) between each warp wire to accommodate the weaving procedure that occurs with the weft wire. Those gaps allow the warp wires to migrate away (see box 88) and toward (see box 89) respective adjacent warp wires which results in wide and narrow opening sizes as illustrated in FIG. 14. The resulting variations or deviations from the screen spacing illustrated in FIG. 14 are greater than the standard industry tolerance as established by ASTM E2016-11, table 8 and those aperture deficiencies were caused by the movement of the warp wires, which the instant invention avoids and/or significantly decreases.

Another problem with the Serpa XLT Screens is that the overcoat urethane material positioned exclusively over the warp and weft wires where the weft wires exist deteriorates at an accelerated rate when used in production facilities. A potential reason for the accelerated deterioration is because the urethane coating is too thin, and without the weft wires the coating could be thicker which may solve this specific Serpa problem.

In addition, the use of weft wires significantly decreases the warp wires' vibration. The decreased vibration stiffens and therefore strengthens the warp wires' sheer wall effect. The sheer wall effect occurs when two wires have a pegged object clogged between the two wires and the pegged object is difficult to unclog or cleaned from the screen. The sheer wall effect is noticeable with the oblong wires due to the oblong wires have "parallel" walls that extend the height of the wires. That sheer wall effect is not noticeable with round wires, which is not a subject of the claimed invention, since the alleged sheer wall effect with round wires is essentially a point on each wire that is closest to an adjacent point on another wire.

The sheer wall effect was not an issue in commonly assigned U.S. Pat. No. 8,353,407 since round wires were utilized. In particular, its support member(s) could be located anywhere on the round wires since the vibration effect was not relevant since there was a minimal sheer wall effect. It was only after applicant applied flattened wire did applicant realize that the location between support members on each screen and the width of each support member was critical in obtaining the desired vibration effect to overcome the sheer wall effect.

The current embodiment of the present invention solves the above-identified problems.

BRIEF SUMMARY OF THE INVENTION

The present invention broadly comprises a screen and a method of making a screen, the screen including a plurality of flattened wires. Flattened wires are (1) round wires that have been compressed, preferably cold compressed, or (2) drawn into the desired flattened shape. In either embodiment, each flattened wire has a length along a y-axis, a width along a x-axis and a height along a z-axis; and (a) a single flattened shape wherein (i) the height is less than, equal to or greater than, preferably greater than, the width, and (ii) one or more height sides are flattened; or (b) a dual flattened shape wherein (i) the height is less than, equal to or greater than, preferably greater than, the width, (ii) one or more height sides are flattened and (iii) one or more width sides are flattened. Collectively, both shapes are referred to as flattened wire. The term flattened refers to a wire's side having a surface that is planar or appears, in relation to a rounded wire, to be planar with a concave or convex edge that is less curvilinear than a rounded wire.

The current screen has a plurality of flattened wires arranged longitudinally in a first direction only. To obtain that arrangement, a first flattened wire and a second flattened wire are positioned in an alignment coordinator to maintain (a) a specific distance from each other for a desired spacing that does not appear to ever contact each other, and/or (b) contact or a second specific distance with each other at spaced intervals along the first and second flattened wires to form a polygonic spacing between the first flattened wire and the second flattened wire where the first and second flattened wires do not contact or appear to contact each other, to form a desired screen spacing. The deviation from the desired screen spacing is equal to or less than the standard industry tolerance as established by ASTM E2016-11, table 8, or about ±3% of the desired precise sizing to obtain a long lasting, high efficiency screen to handle abrasive material. There is also a first polymeric support member that homogeneously encases a first limited selected portion of the plurality of flattened wires wherein the first polymeric support member is (a) transverse to the first direction and (b) applied onto the first limited selected portion of the plurality of flattened wires. Likewise, a second polymeric support member homogeneously encases a second limited selected portion of the plurality of flattened wires wherein the second polymeric support member and the first polymeric member are spaced apart to impart a vibration force, and wherein the second polymeric support member is transverse to the first direction. Moreover, there is no additional metal material in, within, or on the first or second polymeric support members, and the desired screen spacing having a standard industry tolerance is maintained even when the first and second polymeric support members are applied and cured.

The current invention (a) replaces traditional wire cloth and competitors' specialty designs; and (b) lasts far longer than standard "round" wire technology commonly utilized in both standard wire cloth and similar specialty diamond designs when throughput, open area and efficiency are paramount.

The current invention also provides significantly greater open area, improved screen life and throughput for the same mass of round wire used in other traditional screens. For example, those seeking significant increase in throughput and efficiency without reducing the wire diameter for fear of breakage/more frequent change outs with a 1" space, ¼" diameter woven wire -or- a competitor's diamond design.

The instant invention uses a: 1" space ¼" flattened wire (0.192/0.270), wherein the traditional open area of ¼" equals 65%; while the resulting open area of the instant invention equals 70%. Using the instant invention results in a 5% increase in the open areas due to the flattened wire, longer screen life and the accurately sized open areas.

Alternatively, when screen longevity and efficiency are paramount and open area is a lesser consideration (i.e. keeping the same open area as to that of a smaller wire, significantly longer screen and wear life can be achieved by starting with the mass of a larger round wire and profiling to that of the smaller wire diameter. Hence achieving the same open area and throughput of a lighter wire, but with superior wear, longevity and efficiency as a result is obtained by the present invention. For example, if a user is currently using a ½" space and a 0.162 Diameter woven wire or a competitor's diamond design wherein both has an opening area equal to 57%. That throughput and opening area is sufficient and the goal is to significantly increase screen life, reduce change outs and improve screen efficiently. In instant invention a 0.192 wire profiling (aka, flattened wire) to 0.162 width, hence, ½" spacing of 0.192 flattened wire (0.162W/0.207H) results in an opening area of a flattened wire that is of a 0.162 wire which is the same at 57%. This difference is that one now has the superior screen life of approximately a 0.207H diameter wire compared to that of the former 0.162 wire, with the "same" open area. The instant invention provides stronger than round wire counter parts and can withstand heavier loads; wear pattern is from the top (x axis) and the shear walls (y axis) allow more surface area for wear and near size material to deflect down for optimal efficiency as opposed to round wires; pure homogeneous urethane strip technology allows the flattened wires to remain fluid and vibrate at high frequency to drop near size material very efficiently with little to no pegging; and the applicant's tooling technology allows crimps to remain, as perfectly as possible, aligned for precise sizing.

The flattened wires are arranged in a patterned configuration, the method including (a) longitudinally aligning the flattened wires in a first direction only—that means the wires are just "warp wires" and there are NO "weft wires"—and arranging the flattened wires in the patterned configuration so the width sides of each flattened wire are respectively the top screen surface and the bottom screen surface, (b) applying a bead of molten material along a path defined in a second direction, wherein the second direction is transverse or essentially transverse to the first direction, the path is a predetermined distance not covering the entire length of the longitudinally aligned flattened wires, and at a spaced interval along the longitudinally aligned flattened wires if this step is repeated to apply a second bead of molten material, and (c) directly molding each bead of molten material into a support member, wherein the support member encases each flattened wire in the patterned configuration for the predetermined distance at the spaced interval along the longitudinally aligned flattened wires.

In another embodiment, the bead is applied on the flattened wires along a path defined in the first direction, wherein the support member is a lap for the wire screen, and wherein the lap at least partially encases at least one peripheral wire in the plurality of wires.

In another embodiment, the patterned configuration is a (a) polygonic pattern for example and not limited to three sided (forms a triangle shape), four sided (forms a diamond, square, rectangle, trapezoid, parallelogram, or rhombus shape), five sided (forms a pentagon shape), six sided (forms a hexagon shape), and any other polygonic shape having more than two sides; (b) round shape for example a circle or a shape that is circular in shape; (c) herringbone, or (d) harp style pattern.

The current invention also broadly comprises a method of making the above-identified screen with an apparatus. The screen is as identified above and the apparatus includes an arranger, an extruder and a mold. The arranger assists in aligning the plurality of flattened wires in the apparatus as identified above, (b) the extruder applies the bead of molten material on the flattened wires, and (c) the mold directly molds the molten material into a support member as identified above. In one embodiment, the extruder applies the bead to the wires along a path defined in a second direction, wherein the second direction is transverse to the first direction, and wherein the support member is a support strip for fixing the wires in the patterned configuration. In another embodiment, the bead is applied on the flattened wires along a path defined in the first direction, wherein the support member is a lap for the wire screen, and wherein the lap at least partially encases at least one peripheral flattened wire in the plurality of flattened wires.

In one embodiment, the apparatus' arranger includes a plurality of pins, and wherein the flattened wires engage between the pins for longitudinally aligning the wires in the first direction and arranging the wires in the patterned configuration in step (a). In a further embodiment, wherein the apparatus further includes a clamp located proximate the pins for temporarily fixing the flattened wires in the patterned configuration when the clamp is engaged about the flattened wires, and wherein after step (c) the method further comprises: (e) indexing the flattened wires from a first position to a second position by moving the clamp or the mold in the first direction, wherein during moving of the clamp or the mold, the clamp or the mold is closed about the flattened wires for pulling the flattened wires in the first direction from the first position to the second position. In a further embodiment, wherein the mold is closed about the bead and moved in the first direction for indexing the flattened wires in step (e), the method further comprises: (f) retracting the pins for disengaging the pins from the flattened wires at the first position, (g) resetting the clamp to an initial position, (h) redeploying the pins for re-engaging with the flattened wires at the second position, and (i) releasing the support strip by opening the mold. In yet a further embodiment, after step (i), at least one subsequent support strip is formed by generally repeating steps (a)-(i) for each subsequent support strip.

An embodiment that addresses the above-identified size, through-put, screen life, accurate spacing parameters and self-cleaning problems is the use of flattened wire having desired vibration characteristics and/or accurate spacing parameters in screens. Use of the flattened wire embodiment decreases the chance of properly sized particles not passing through the screen since the side surface(s) are flattened.

In the diamond pattern, serpentine flattened wire embodiment has a first, proximal, serpentine-shaped wire; a third, distal, serpentine-shaped wire; and a second, serpentine-shaped wire positioned between the first and third wires. The second wire's flattened side surface's (a) trough contacts or approximately contacts the first wire's flattened side surface's crest, and (b) crest contacts or approximately contacts the third wire's trough to form a plurality of warp, flattened wire screen embodiment.

Alternatively, the flattened wire and the rounded wire can be alternated in the screen embodiment to achieve the benefits of a rounded wire and flattened wire—allow proper sized particles to pass there through and be self-cleaning. The crux of this embodiment is to utlize a desired wire size to increase the desired open areas with accurate, consistently sized apertures that also result in the desired increased screen life.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary.

It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1A:
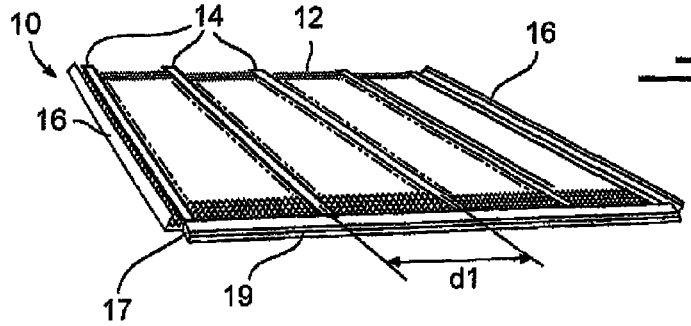
FIG. 1A is a perspective view of a screen made according to the current invention method.

Referring now to the drawings, FIG. 1A illustrates wire screen 10 which is one embodiment of screen that can be manufactured by the current invention method. Wire screen 10 is a self-cleaning screen, and accordingly includes flattened wires 12 which are longitudinally arranged along the x-axis only.

Flattened wires are (1) round wires that have been compressed, preferably cold compressed, or (2) drawn. In either embodiment, each flattened wire has a length along a y-axis, a width along a x-axis and a height along a z-axis; and (a) a single flattened shape wherein (i) the height sides (h) are less than, equal to or greater than, preferably greater than, the width sides (w), and (ii) one (see FIGS. 1*d*, 1*e* and 1*h*) or more (see FIGS. 1*c*, 1*f*, and 1*g*) height sides (h) are flattened; or (b) a dual flattened shape wherein (i) the height sides (h) are less than, equal to or greater than, preferably greater than, the width sides (w), (ii) one (see FIGS. 1*d*, 1*e*, and 1*h*) or more (see FIGS. 1*c*, 1*f*, and 1*g*) height sides (h) are flattened and (iii) one (see FIG. 1*e*) or more (see FIGS. 1*g* and 1*h*) width sides (w) are flattened. Collectively, both shapes are referred to as flattened wire. The term flattened refers to a flattened wire's side having a surface that is planar or appears, in relation to a rounded wire, to be planar with a concave or convex edge that is less curvilinear than a rounded wire.

The flattened wires are arranged in a patterned configuration, the method including (a) longitudinally aligning the flattened wires in a first direction only—that means the wires are just "warp wires" and there are NO "weft wires"—and arranging the flattened wires in the patterned configuration so the width sides of each flattened wire are respectively the top screen surface and the bottom screen surface, The flattened wires are crimped and arranged so that it has a pattern that generally resembles a typically woven screen. That is, the wires can be arranged so that adjacent wires form a (a) polygonic opening for example and not limited to three sided (forms a triangle shape—see FIG. 2*c*), four sided (forms a diamond (see item 15*a* at FIG. 2*a*), square, rectangle, trapezoid, parallelogram, or rhombus shape), five sided (forms a pentagon shape), six sided (forms a hexagon shape), and any other polygonic shape having more than two sides; (b) round opening for example a circle or a shape that is circular in shape; (c) herringbone opening-pattern (see FIG. 2*b*), or (d) harp style opening-pattern (see FIG. 2*d*).

Moreover, the flattened wires have a first flattened wire and a second flattened wire that contact each other at spaced intervals along the first and second flattened wires to form a polygonic spacing. The polygonic spacing has a deviation from the desired screen spacing that is equal to or less than the standard industry tolerance as established by ASTM E2016-11, table 8 or about ±3% of the desired precise sizing to obtain a long lasting, high efficiency screen to handle abrasive material. There is no additional metal material in, within, or on the first or second polymeric support members, and the desired screen spacing having a standard industry tolerance is maintained even when the first and second polymeric support members are applied and cured.

Reverting to Figure la, support strips 14 are included to, support the wires, control the vibration to a desired level, and are oriented perpendicular to the direction of the wires, as indicated by the y-axis. Each support strip is preferably spaced distance d1 from adjacent support strips.

Screen 10 may also include hooked ends 16 which engage with correspondingly bent receiving structures on the decks of a shaker machine into which the screen is intended to be installed. When installed in a shaker machine, the support strips are preferably aligned so they arrange with and over the support beams or bars of the shaker machine's deck.

Figure 1B:
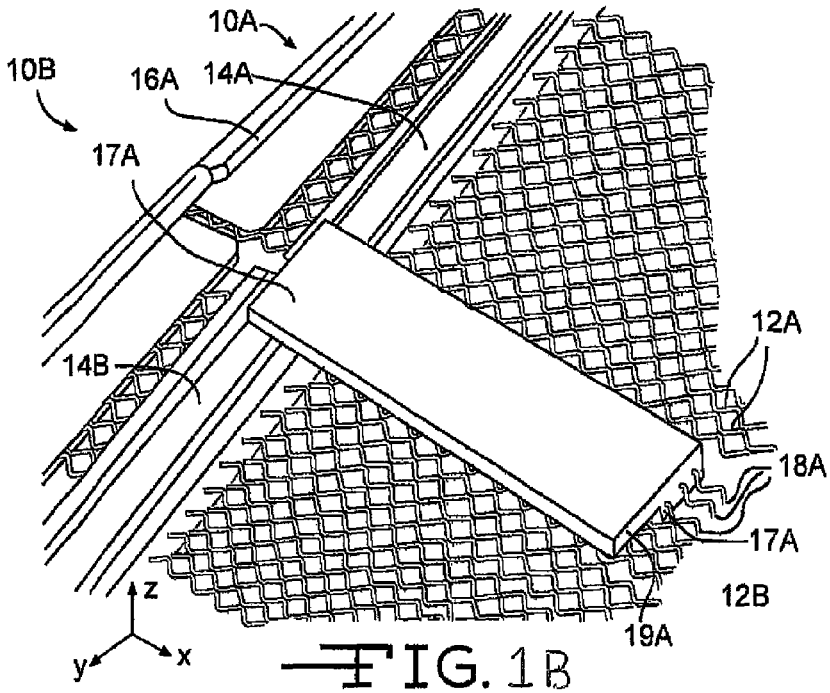
FIG. 1B is a partial perspective view illustrating a lap on a first screen overlapping a second screen with a portion of the lap cutaway.
Figures 1C, 1D, 1E, 1F, 1G, 1H:
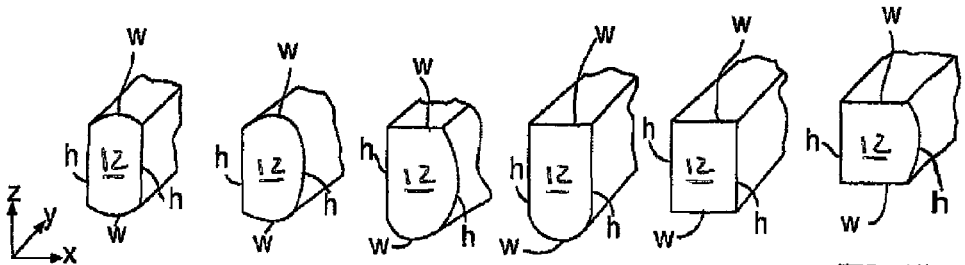
FIGS. 1C to 1H illustrate various embodiments of the flattened wire used in FIG. 1B at box 1.

Large industrial shakers are designed to receive more than one screen at a time. To minimize the probability of extraneous material getting through a gap located between two adjacent screens, each screen may include a lap for covering any potential gaps between two screens. Two screens designated 10A and 10B are illustrated, which are substantially identical to screen 10, are shown in FIG. 1B. However, for identification purposes, elements of screen 10A are additionally designated with the letter A and elements of screen 10B with the letter B after the corresponding reference numeral. Thus, screen 10A includes lap 17A which is formed about peripheral flattened wires 18A, and orientated in the x-direction, parallel to the longitudinal direction of the wires.

Lap 17A is shown cutaway to reveal three peripheral flattened wires 18A encased by the lap. The peripheral flattened wires 18A in lap 17A do not vibrate as well as the flattened wires not in lap 17A. Lap 17A includes flange 19A which overlaps flattened wires 12B of screen 10B for covering any gaps which may be created between screen 10A and 10B.

Figure 2A:
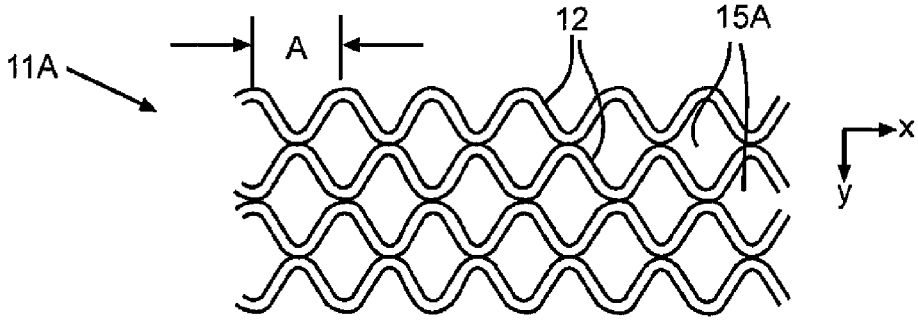
FIG. 2A is a diamond style pattern for a screen.
Figure 2B:
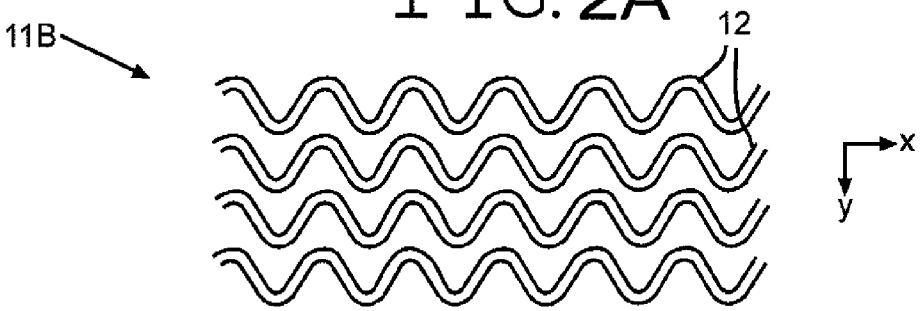
FIG. 2B is a herringbone style pattern for a screen.
Figure 2C:
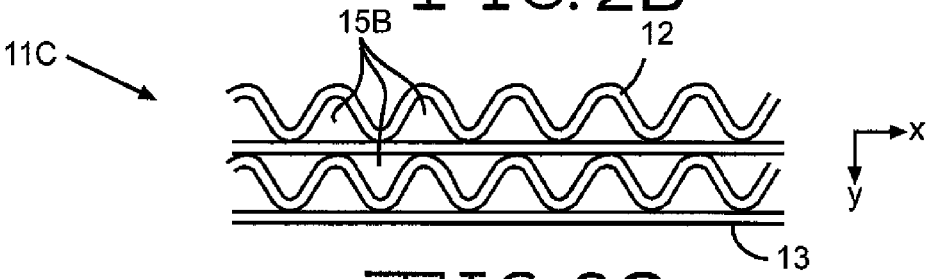
FIG. 2C is a triangle style pattern for a screen.
Figure 2D:
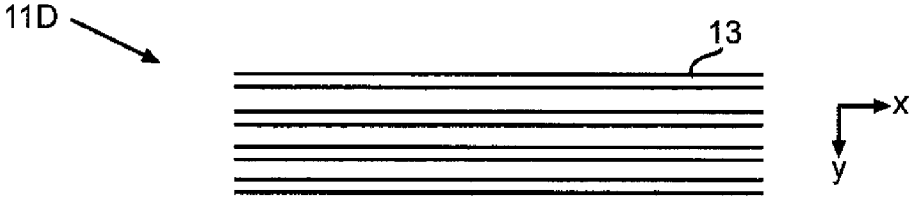
FIG. 2D is a harp style pattern for a screen.
Figure 2E:
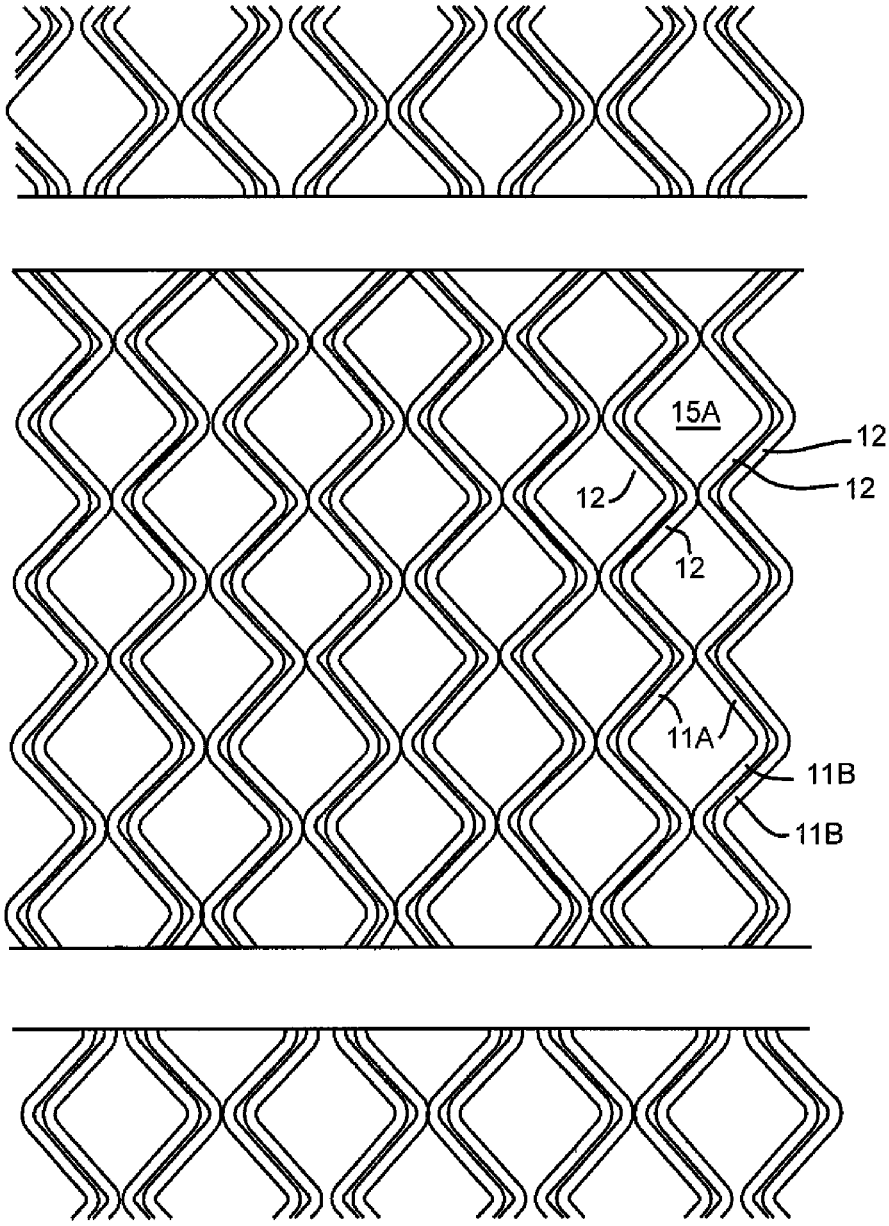
FIG. 2E is a diamond style pattern for a screen wherein each wire is doubled up to create a double warp wire weave.

FIGS. 2A-2E show several possible embodiments of flattened wire screens having different configurations. Diamond pattern 11A is shown in FIG. 2A including crimped flattened wires 12, which are arranged out of phase with respect to each other. By "out of phase," it is meant that each crimped flattened wire generally resembles an undulating wave having a wavelength λ, and that every other flattened wire is shifted by one-half wavelength, so that the crimps of adjacent flattened wires are misaligned and touch. This arrangement results in diamond-shaped openings 15A. Herringbone pattern 11B includes crimped flattened wires 12 arranged such that the wires are aligned in phase. By "in phase," it is meant that the crimps are aligned and do not touch, unlike the diamond pattern. A combination of herringbone pattern and out of phase pattern is illustrated at FIG. 2E. Triangle pattern 11C includes alternating crimped flattened wires 12 and straight flattened wires 13, for forming triangle-shaped openings 15B. Harp pattern 11D includes only straight flattened wires 13 and no crimped wires. It can be seen that the flattened wires in each pattern are arranged in only a single longitudinal direction. It should be understood that these are only four examples of possible configurations for screen 10, and that other configurations with varying styles and layouts of flattened wires are possible according to the current invention method. Despite the repeating nature of the above exemplary configurations, the term "pattern" does not necessarily require repetition, and any pattern, including one created by randomly arranging different wires would also be within the scope of the current invention. Screen 10 will be shown throughout the Figures always utilizing diamond pattern 11A.

Apparatus 20 is arranged to perform the current invention method of manufacturing flattened wire screens. Apparatus 20 is shown in front, rear, and side views, respectively, in FIGS. 3-6. Apparatus 20 generally includes framing 22 which supports a pair of parallel rails 24 arranged in the x-direction, and beam 26 in the y-direction. Track 27 is generally formed along beam 26, and may simply be the front surface of the beam, or include a protrusion or protrusions for defining the track. By "in the x-direction" or "along the x-axis," it is meant generally along or parallel to the corresponding x-axis shown in the Figures. By "in the y-direction" or "along the y-axis," it is meant generally along or parallel to the corresponding y-axis shown in the Figures. If a positive direction is specified herein, it means in the direction indicated by the arrowhead of the corresponding axis. A negative direction indicates the direction opposite the positive direction, namely, a 180 degree difference. If no positive or negative direction is specified, it generally means in both or either direction. The x-axis and y-axis are perpendicular with respect to each other; while a z-axis is perpendicular with both the x- and y-axes.

Clamp 28, mold 30, and screen support 32 are included between rails 24, and are moveable along rails 24 in the positive and negative x-directions. Throughout FIGS. 3-6, clamp 28 and mold 30 are generally shown in their respective open positions. In one embodiment, the movement of clamp 28, mold 30, and/or screen support 32 is achieved by use of threaded rods 33 contained in and along each rail, with each rod part of a corresponding ball screw mechanism. The rods are preferably actuated by a single motor with appropriate couplings to simultaneously drive both-threaded rods. Extruder 34 includes a nozzle 36 and is mounted on beam 26 and moveable along track 27 in the positive and negative y-directions. In the illustrated embodiment, hopper 37 stores plastic pellets to be fed to extruder 34, such as by a vacuum or pressurized air system through hoses 38 and directed into the extruder by funnels 39.

Figure 4:
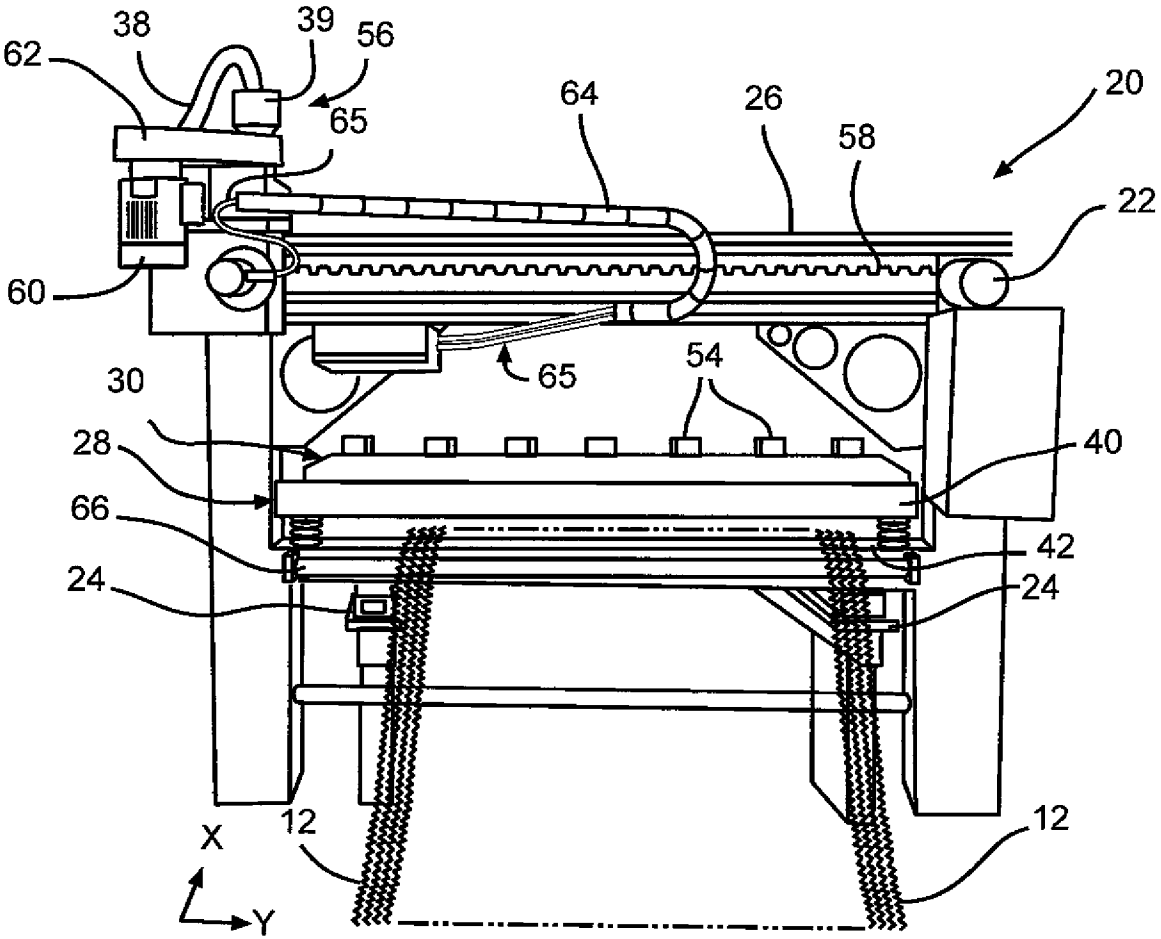
FIG. 4 is a rear view of the apparatus shown in FIG. 3.
Figure 5:
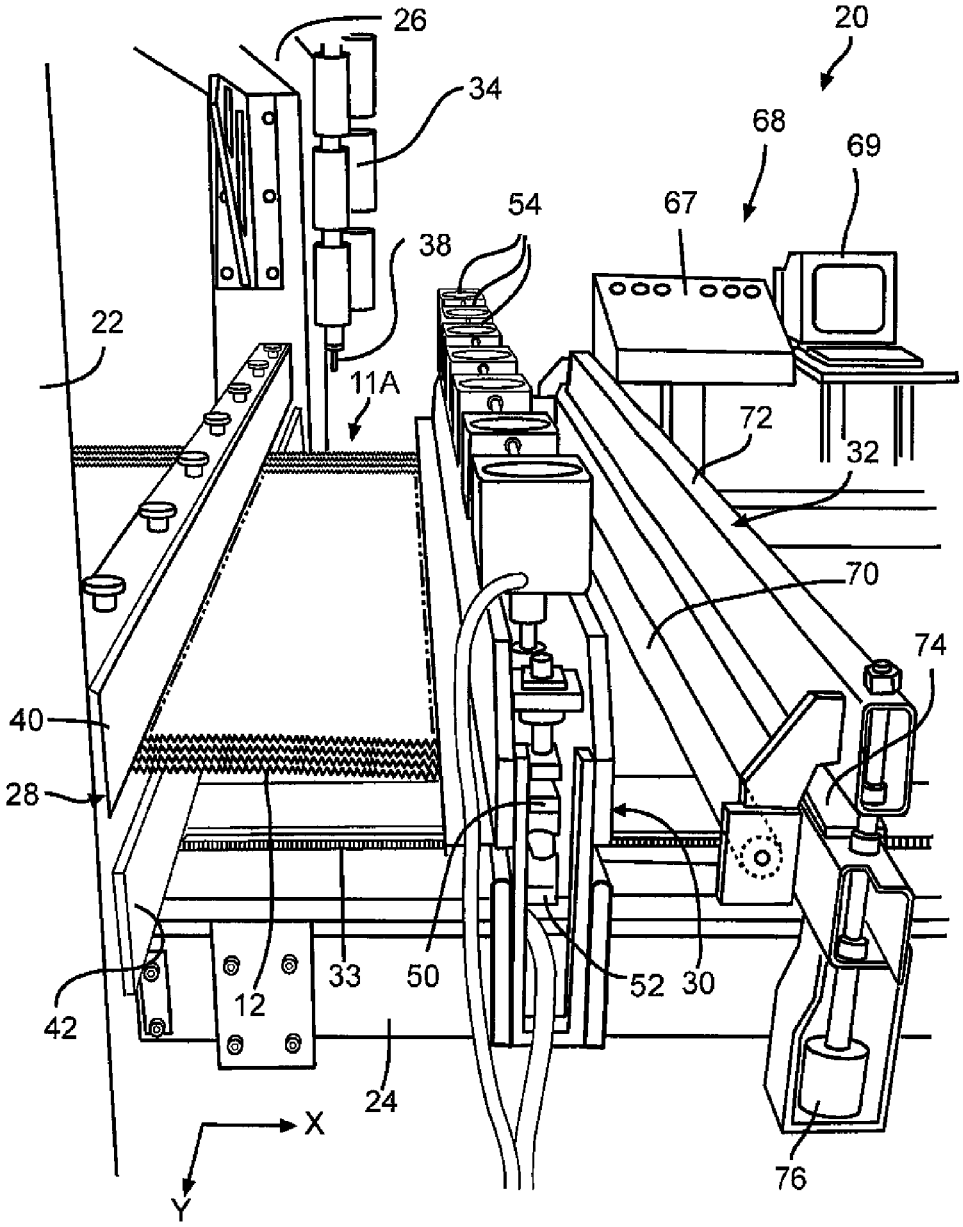
FIG. 5 is a left side view of the apparatus shown in FIG. 3.
Figure 6:
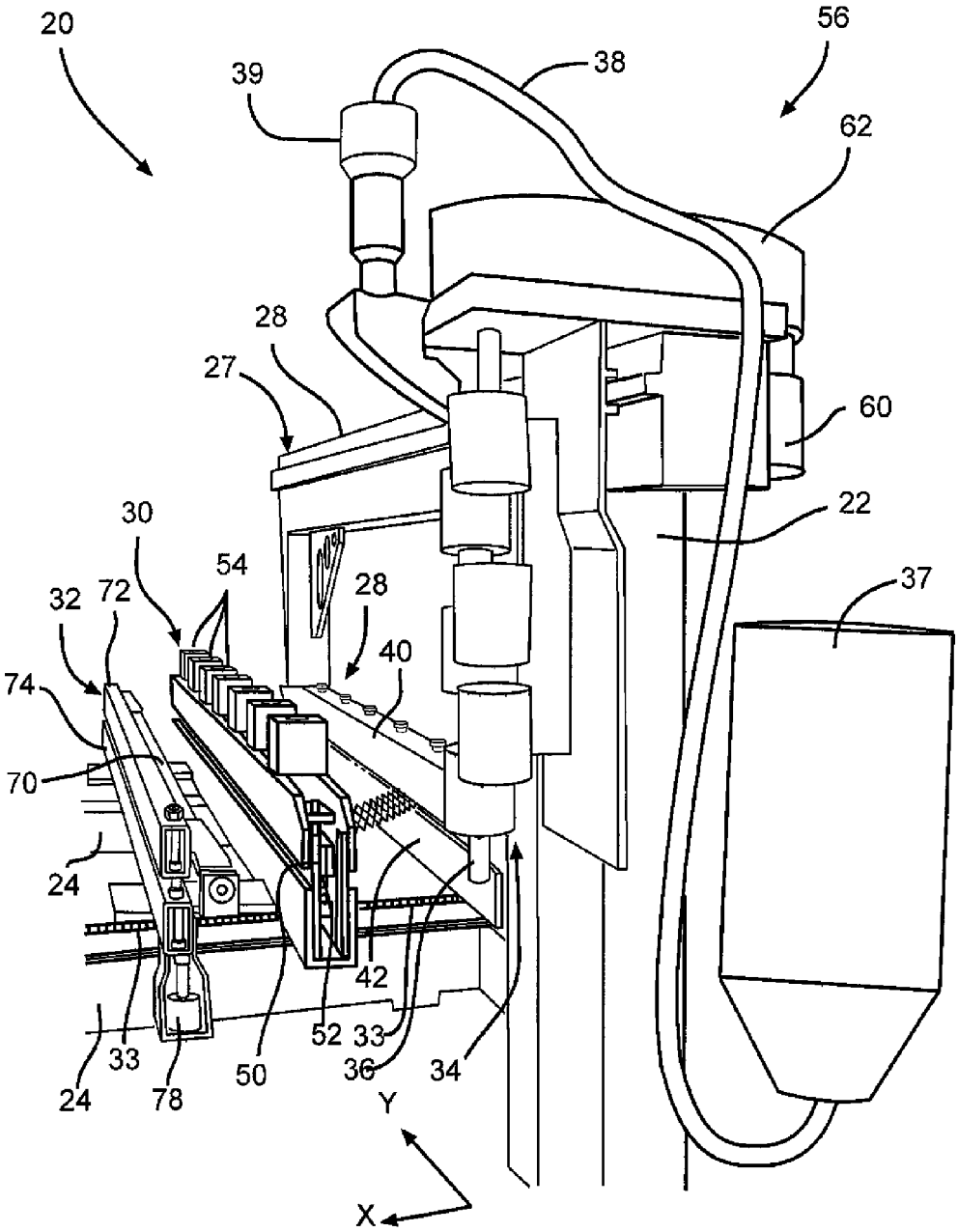
FIG. 6 is a right side view of the apparatus shown in FIG. 3.

Apparatus 20 is shown from the rear in FIG. 4 before the formation of any support strips, so that the majority of flattened wires 12 are extending out of the rear of the apparatus. Support bar or roller 66 is located proximate to clamp 28 on the rear side of the apparatus for supporting the flattened wires, and urging them into a generally horizontal orientation for better engagement between the jaws of the clamp.

Figure 7A:
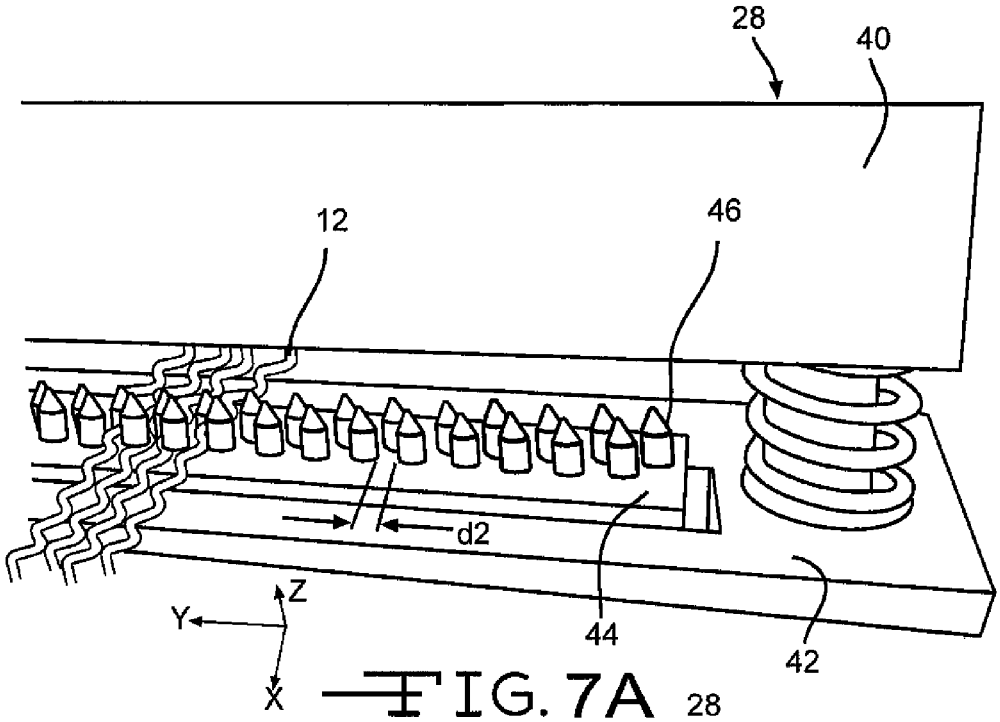
FIG. 7A is an enlarged view illustrating a pin block having a plurality of pins engaged with a sample of wires.
Figure 7B:
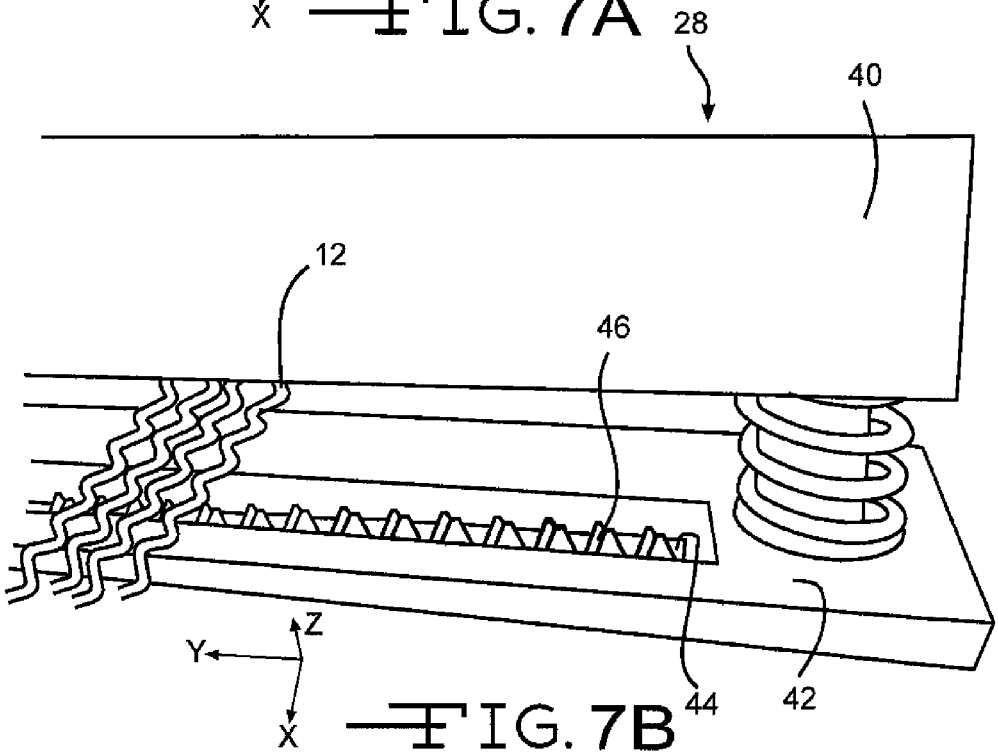
FIG. 7B is an enlarged view illustrating the pin block of FIG. 7A in a retracted position, disengaged from the wires.

Referring now also to FIGS. 7A and 7B, clamp 28 includes upper jaw 40 and lower jaw 42. An alignment coordinator 44, for example and not limited to a pin block is secured in lower jaw 42, a machined bar of metal or plastic with or without grooves, a laser position locator, or equivalents thereof. The pin block 44 includes a plurality of pins 46 protruding upwards from the block. The upper jaw may include a corresponding block (not shown) which includes apertures to receive the pins, so that the upper jaw can clamp down tightly on the lower jaw. In FIG. 7A, a sampling of flattened wires 12 can be seen installed about pins 46. The pins are arranged and spaced in the pin block so that when the flattened wires are engaged with the pins, the pins properly align the flattened wires in the desired final configuration of the screen. In the illustrated embodiment, the pins are shown in two rows, staggered with respect to each other, where the pins are equally spaced apart from each other by distance d2. The distance d2 is defined such that the pins will generally hold the flattened wires into the final desired configuration for the screen. For the illustrated embodiment pins used to create diamond pattern 11A, distance d2 is approximately equal to twice the diameter or gauge of the flattened wires, because two flattened wires must fit between each pair of adjacent pins. A similar distance of approximately two flattened wire diameters would be used for triangle pattern 11C, while only approximately one diameter would be utilized for a distance between pins in an apparatus arranged to create herringbone or harp style screens. Advantageously, this forces the flattened wires into alignment so the flattened wires exhibit the final configuration of the screen when engaged between pins 46. In the illustrated embodiment, the tops of the pins are tapered to facilitate the engagement of the flattened wires with the pins.

In one embodiment, the pins are retractable, so that the screen can be removed from the apparatus, or repositioned with respect to the apparatus for the formation of subsequent support strips, as will be discussed in greater detail below. As illustrated at FIG. 7B, the entire pin block may be arranged so that it can drop into lower jaw 42, effectively retracting pins 46 from flattened wires 12, as illustrated. When the screen is moved, or flattened wires of a new screen arranged in apparatus 20, the pins are redeployed so that they can engage with the flattened wires again.

In one embodiment, pins 46 are built directly into clamp 28 as a permanent part of clamp 28. However, according to the shown embodiments providing the pins in a pin block enables the entire pin block to be removable from the clamp. In this way, pin blocks having varying designs of pins can be readily exchanged in clamp 28 so that apparatus 20 is adaptable to receive any combination of straight, crimped, or other styles of flattened wires, as needed, by switching which pin block is installed in the apparatus. For example, if apparatus 20 were adapted to make a harp style screen (including harp pattern 11D shown in FIG. 2D) then the corresponding pin block may have only a single row of pins, with each pin spaced a distance equal to the diameter of the flattened wire from adjacent pins, for aligning the flattened wires in straight rows, as required by harp pattern 11D.

Extruder 34 is mounted on carriage 56, which is moveable down the length of beam 26 along track 27. In the shown embodiment, the carriage is mounted above the beam and on front and rear opposite sides of beam 26. In the shown embodiment, carriage 56 traverses the length of the beam by use of a motorized pinion gear (hidden) that is engaged with rack 58. It should be appreciated that other means of mobilizing carriage 56 could be substituted for a rack and pinion, such as a continuous chain drive, or the like. In one embodiment, extruder 34 is a screw type extruder which liquefies solid pellets into a viscous molten state by submitting the pellets to increased heat and pressure due to the rotation and operation of the screw. In the shown embodiment, the screw is powered by motor 60 via a belt, which is held under belt guard 62. Articulated cover 64 provides flexible protection and support for electrical wires and cables 65 which run to the extruder carriage, which enables the cables to move with the carriage as it traverses beam 26, without a risk of entanglement of or damage to the flattened wires.

Figure 8A:
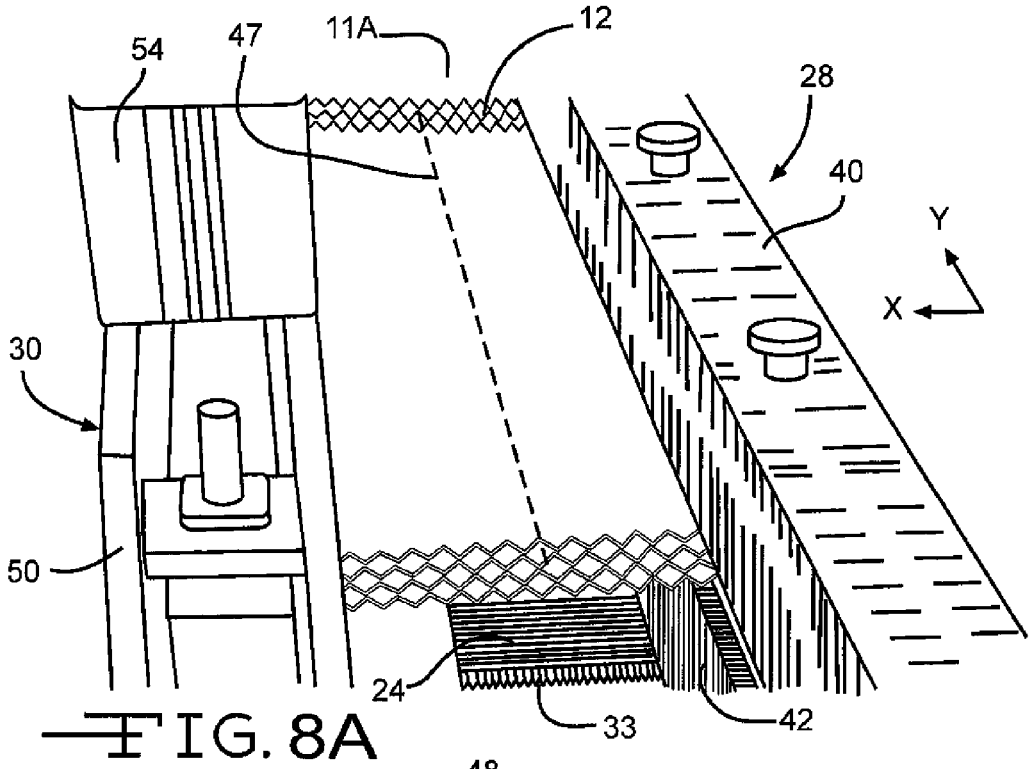
FIG. 8A is an enlarged view of a plurality of wires arranged in a diamond pattern in the apparatus shown in FIG. 3.
Figure 8B:
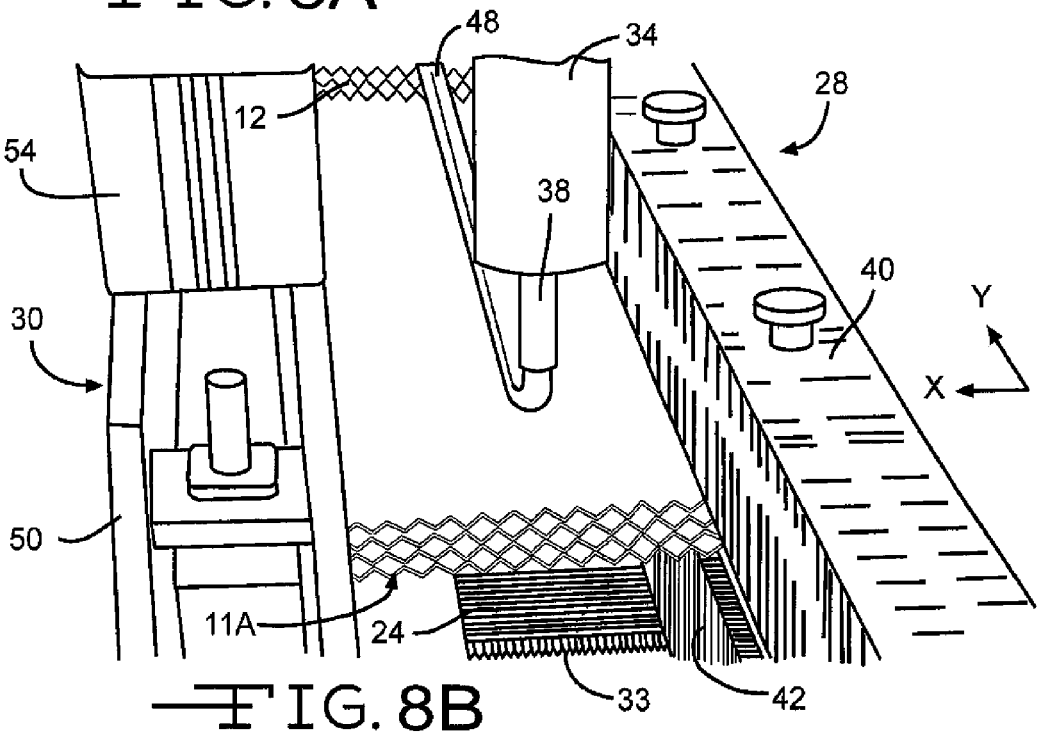
FIG. 8B is substantially the same view shown in FIG. 8A, illustrating the extrusion of a bead of molten material on the wires.

FIG. 8A shows an enlarged view of wires 12 secured in place by clamp 28 after being engaged between pins 46 of pin block 44. It can be seen that the pin block and clamp ensure that the flattened wires exhibit the final configuration of screen 10; a diamond pattern 11A in the illustrated embodiment. The support strip is formed in the illustrated area located between clamp 28 and mold 30 generally along the path indicated by dashed line 47. FIG. 8B shows extruder 34 in the process of placing bead 48 of molten material via nozzle 36 over flattened wires 12 as the extruder travels along track 27 in the negative y-direction. By "molten," it is meant that the material is in a state which allows the material to be shaped or molded, specifically by mold 30. The bead is aligned in the y-direction, perpendicular or transverse to the length direction of the flattened wires. Mold 30 is then moved in the negative x-direction along rails 24 and positioned so that jaws 50 and 52 of the mold are aligned to surround the bead. The mold is then clamped down on the bead via pistons or rams 54 so that the molten bead is molded into support strip 14 to encase selected portions of the flattened wires to obtain the desired vibration, through put, and screen life's characteristics of the flattened wire screen design of the instant invention.

Pistons or rams 54 may be hydraulically, pneumatically, or mechanically activated. Numerous pistons or rams are included down the length of both upper and lower jaws 50 and 52 to ensure that pressure is equally distributed on the mold.

The material of bead 48 preferably comprises a polymer, and even more preferably comprises polyurethane. The use of polyurethane enables support strip 14 to be resilient and durable as required for industrial applications to obtain the above-identified screen characteristics. It is conceivable that other types of materials may be desired to construct support strip 14 according to the current invention method.

Control unit 68 may be included to electronically control the components of apparatus 20, as will be described in more detail below. The control unit communicates with apparatus 20 by any feasible means in the art, such as standard data cabling. One of ordinary skill in the art will readily appreciate that a number of routines or functions of the apparatus or components of the apparatus are easily adaptable for automation in any number of ways, such as with motors, actuators, gears, pistons, and the like, powered by electrical, mechanical, pneumatic, or hydraulic means. The control unit may include control board 67 which may further include a master on/off switch, status indictor lights for indicating if the system is turned on, off, or in a standby or test mode, an emergency off switch, or the like. Additional functions may be controllable by a user by inputting commands into a graphical user interface displayed on monitor 69, as also described in more detail below.

Figure 9:
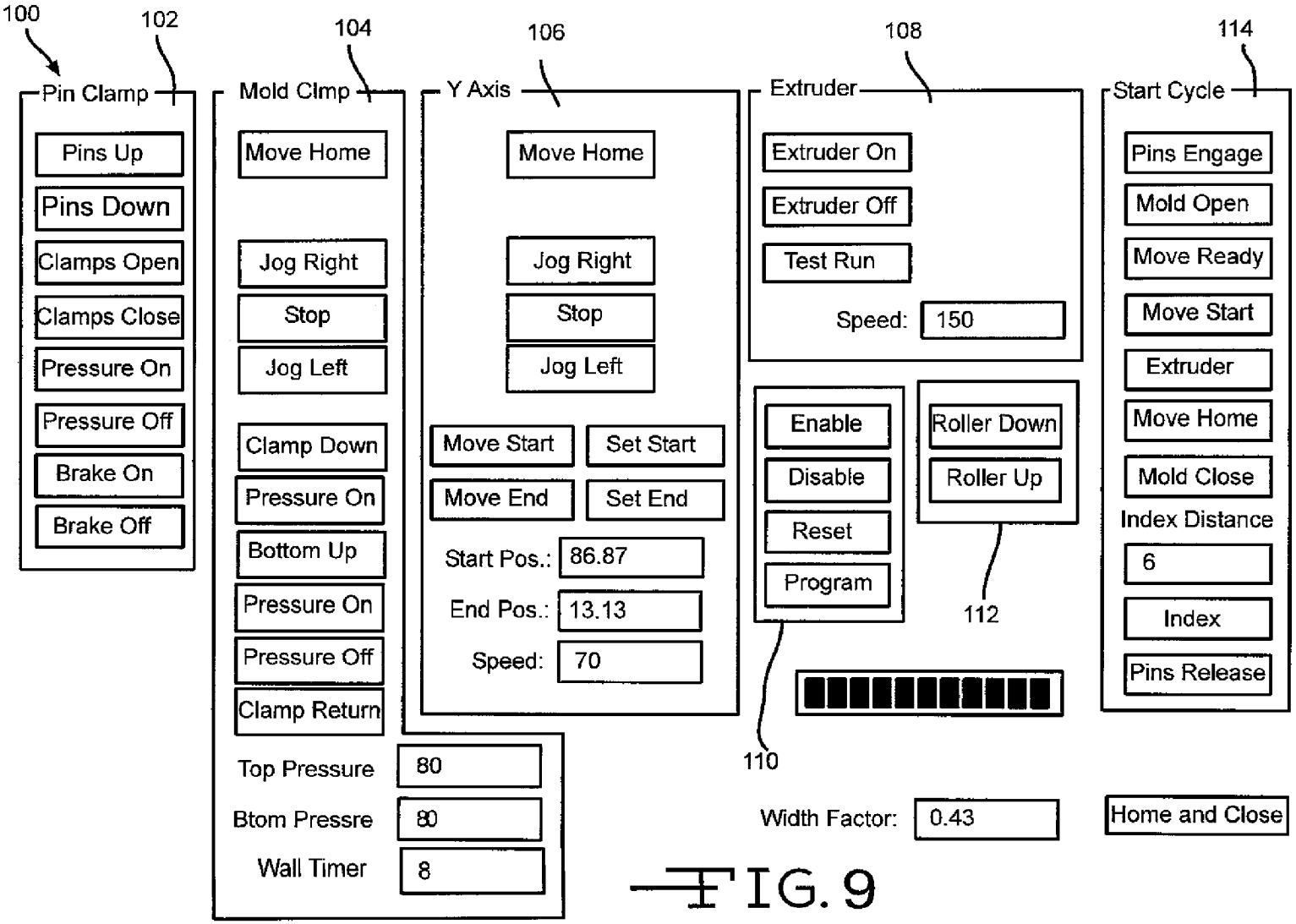
FIG. 9 is a potential graphical user interface for operating the apparatus shown in FIG. 3; and, FIG. 10 is a perspective view of a second embodiment apparatus according to the current invention for forming a lap.

FIG. 9 illustrates graphical user interface 100 for control unit 68. It should be appreciated that this is only one embodiment of a graphical interface, and that other interfaces may be used. The interface is displayable on an electronic display means, such as computer monitor 69 and operated by typical computer peripherals such as a keyboard and mouse. The graphical interface enables a user to electronically issue commands to control the various components of apparatus 20. In one embodiment, a user inputs a command to the control unit by selecting a button displayed on the graphical user interface and clicking a mouse attached to control unit 68. In the illustrated embodiment, clamp controls 102 include buttons, which if activated by a user, cause pins 46 to deploy or retract (as described with respect to FIGS. 7A and 7B), open or close the clamp, turn the pressure to the clamp on or off, or to engage or disengage a braking means so that the clamp can not move along rails 24 in the x-direction.

Figure 3:
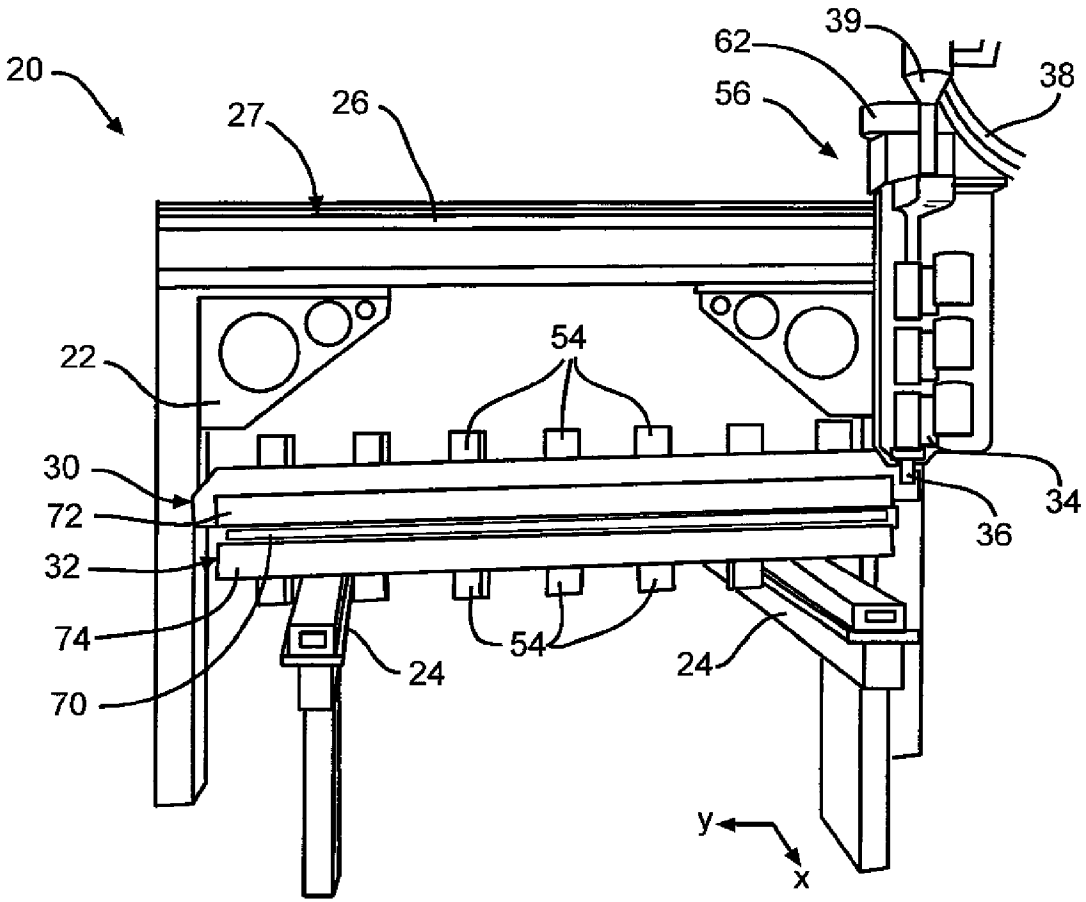
FIG. 3 is a front view of an apparatus according to the current invention.

Mold controls 104 include buttons which move the mold in position over line 47 where bead 48 is formed, to jog right or jog left, to stop movement, to turn the pressure to the pistons of the mold on and off, move the upper jaw down or the bottom jaw up, and to move the mold out of the way of the extruder in the positive x-direction, as well as textboxes which enable the user to enter the precise pressure that the pistons exert on the upper and lower halves of the mold, as well as how long the mold should remain closed. Y-axis controls 106 control the movement of the extruder carriage to move to a home position as shown in FIG. 3, to jog left or right, to stop movement, to move to a start position opposite from the home position, and to move from the start position to the home position. Y-axis controls 106 also may include textboxes for receiving values by the user to define the speed of movement of the carriage, as well as the start and end, or home, positions of the carriage.

Extruder controls 108 enable the extruder to turn on or off, to run a test, and also include a textbox which enables a user to specifically input the speed at which bead 48 is to be extruded. System controls 110 include buttons to turn the master power to the system on or off, or to reset the system. Roller controls 112 include controls for raising and lowering the height of the upper jaw of support means 32, to properly position roller 37. Cycle controls 114 include many of the previously described functions conveniently ordered from top to bottom in the generally required sequence to perform the current invention method using apparatus 20. It should be appreciated that in other embodiments of the current invention apparatus there may be more or less controls as needed. Furthermore, it should be understood that a variety of motors, actuators, cabling, electrical wires, and other electrical and mechanical devices may be required to complete the above described or other functions, which have been excluded from the Figures for clarity. There are a near limitless number of ways to complete such functions, many of which will be readily apparent to one of ordinary skill in the art based on the shown and described arrangement of apparatus 20, or which are described according to the shown embodiment of the invention.

The following describes a present invention method specifically for making self-cleaning screen 10 via apparatus 20. Although the method is presented in a general sequence for clarity, no order should be necessarily inferred from the sequence unless explicitly stated. In a first step, a plurality of flattened wires 12 are engaged with pins 46 of pin block 44. For example, by engaging about the pins, the flattened wires are urged into the illustrated diamond-pattern configuration that is utilized by screen 10. As previously discussed, the flattened wires are longitudinally arranged along the x-axis only. That is, there are no flattened wires which are arranged in the y-direction. A portion of the flattened wires extends past the pins in the positive x-direction. Support strip 14 is formed on the shown portion of the flattened wires generally along the path designated by line 47 at FIG. 8A.

Once the flattened wires are properly arranged and engaged with pins 46, clamp 28 is closed for holding the flattened wires in the desired patterned configuration. Mold 30 is preferably open and set to a position in the positive x-direction away from the path of the extruder to ensure the extruder is free to apply bead 48 of molten material across selected and limited sections of the flattened wires. The extruder is moved in the positive y-direction to its starting position. The extruder is then activated and begins extruding a bead of molten plastic from nozzle 36 of extruder 34 supplied by pellets from hopper 37 via hoses 38. The extruder moves along track 27 in the negative y-direction. The extruder is propelled along the beam in the y-direction by a gear engaged with rack 58 while applying bead 48 as shown at FIG. 8B.

Once the bead is applied across selected and limited section(s) of the flattened wires, mold 30 is moved so that bead 48 is located between jaws 50 and 52 of the mold. Pistons 54 are then activated to close the mold around bead 48. Since the bead is still molten, it takes the form designated by the cavity of mold 30, specifically in the illustrated embodiment, of a bar which runs along the y-axis transverse to the flattened wires, and which encases the flattened wires at the designed and selected locations—never the entire screen. Once the molded support strip is sufficiently cooled, the mold can be opened, releasing the support strip. The mold may include sealing means, such as gaskets or seals, on either side of the mold cavity to ensure excess bead polymeric material does not creep out of the mold and down the flattened wires.

As shown in FIGS. 1A and 1B, screen 10 has multiple support strips 14. Each support strip is made generally executing the above described steps. The following paragraphs describe how apparatus 20 is generally reset back to its initial position for the formation of subsequent support strips. Again, the process does not necessarily have to occur in the below described order and no sequence of steps should necessarily be inferred by the below description. Before the mold opens, the mold may first move in the positive x-direction a predetermined indexing distance. That is, the screen is "indexed" from a first position to a second position, where the first position is located the indexing distance from the second position in the x-direction. Since the mold is still clamped down on the flattened wires while the mold moves the indexing distance, the flattened wires are accordingly moved along with the mold. By making the indexing distance equal to distance dl, the desired spacing between each subsequent support strip, the indexing will place the flattened wires in the proper position relative to the extruder nozzle to receive a bead of plastic for the formation of a subsequent support strip. In one embodiment, clamp 28 is still closed and pins 46 engaged with the flattened wires during the indexing, to help ensure the flattened wires stay properly aligned during indexing.

Alternatively, mold 30 could be released once the first support strip is cooled, and the indexing movement performed by clamp 28 and/or pins 46. In another alternate embodiment, the pins could be retracted, thus disengaging them from the flattened wires, and clamp 28 opened before the indexing. Regardless, after the position of the flattened wires has been indexed by the movement of clamp 28, mold 30 or both, clamp 28 is set to its start position. If the clamp was not released prior to indexing, it would of course need to be opened and the pins disengaged before returning to the starting position. After returning to the starting position, the pins are once again engaged with the flattened wires, so that the flattened wires at the second position are held in proper alignment, just as with the very first step described above. The steps are then repeated, as needed, to form the desired number of support strips for screen 10.

As more support strips 14 are added during the formation of the screen, the flattened wires are incrementally pulled forward in the positive x-direction.

Figure 10:
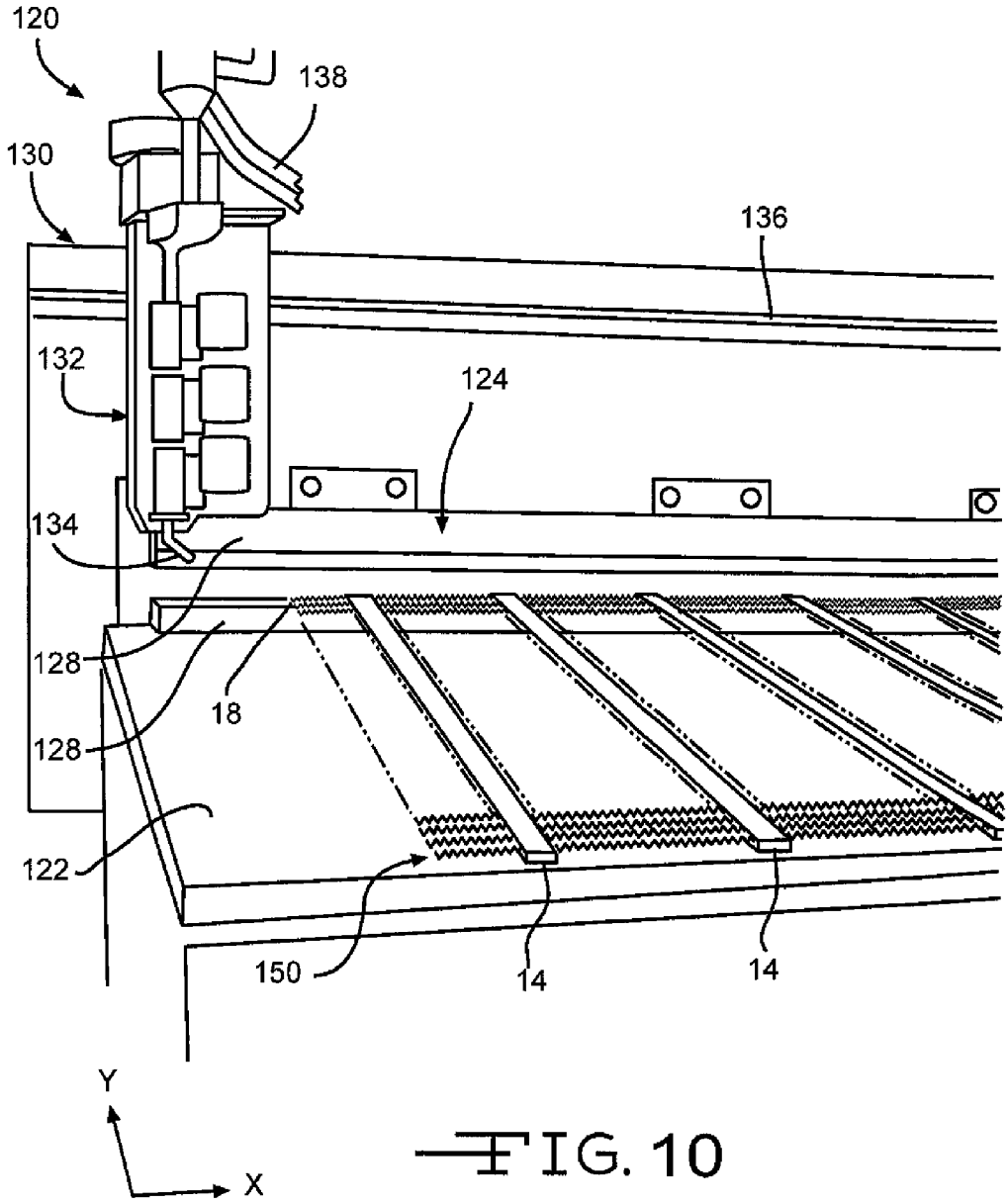
Figure 11:
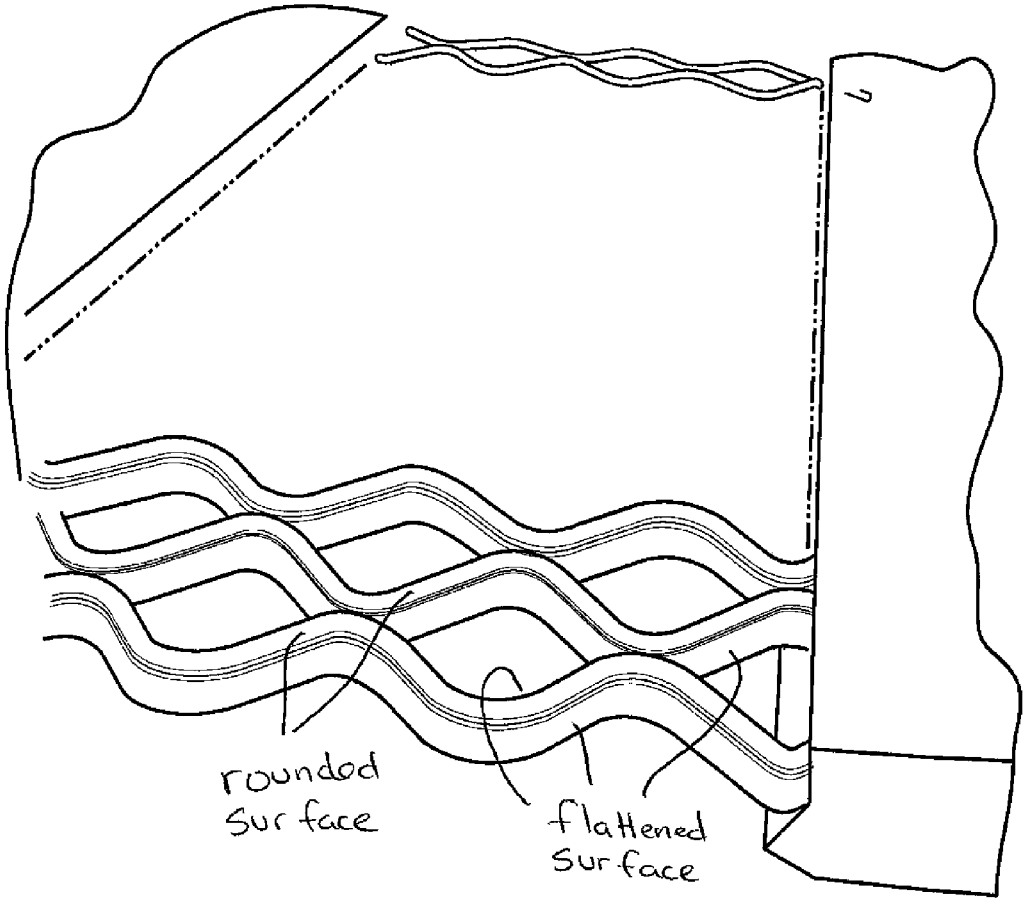
FIGS. 11 to 13 are alternative embodiments of the present invention.
Figure 12:
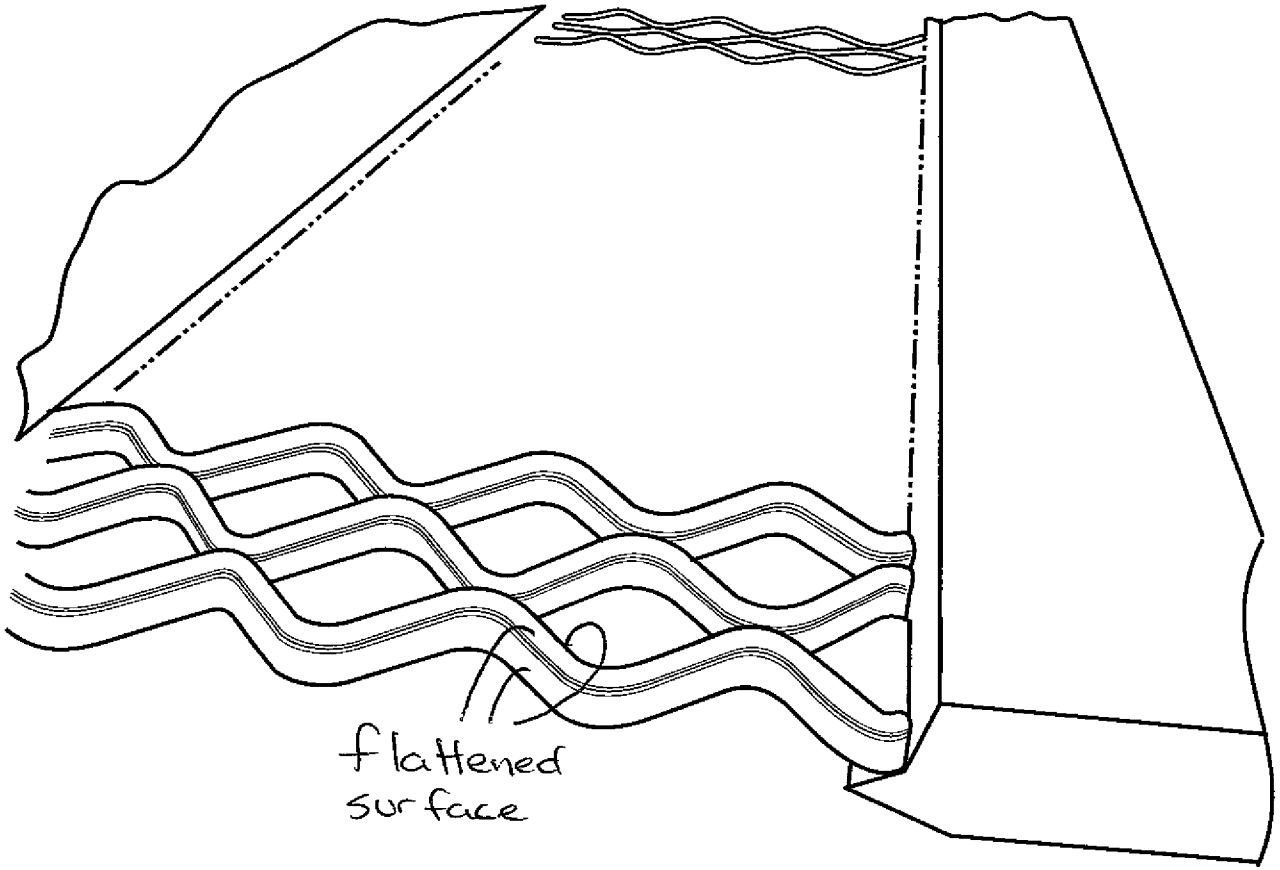
Figure 13:
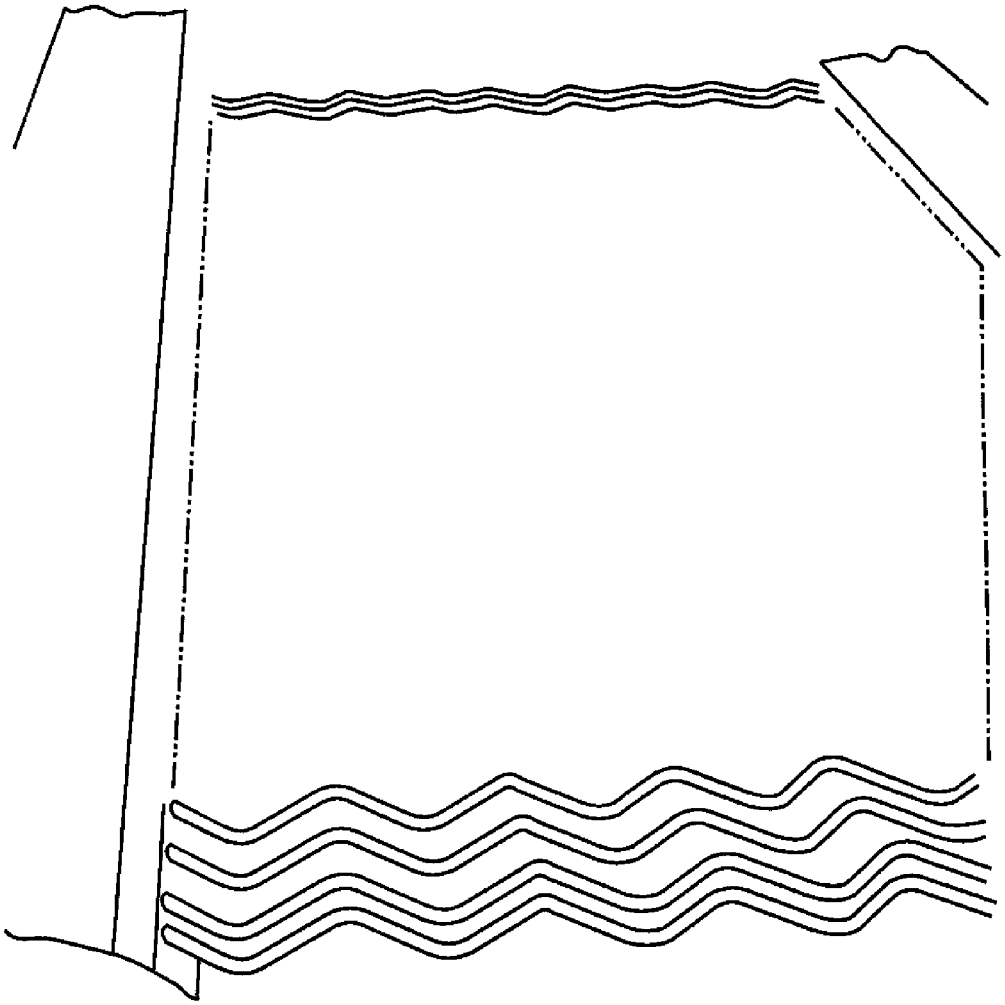

Consequently, the portion of the flattened wires which extends past clamp 28 and mold 30 will continue to increase. Support means 32 is included with roller 70 to provide support for this portion of the screen. The support means includes upper and lower halves 72 and 74 which can be separated by means of piston 76. This allows the roller to be raised or lowered to provide support at varying heights, as needed to balance and hold flattened wires 12 while screen 10 is being formed. Support means 32 is also moveable along rails 24, such as by threaded rods 33. FIG. 10 illustrates lap apparatus 120 which is used to create lap 17 on each screen. Incomplete screen 150 is shown, such substantially resembles screen 10 in that it includes flattened wires 12 arranged in a desired pattern, supported by support strips 14, but in that it does not include a lap. Screen 150 is manufactured such as by the above described method performed by apparatus 20. Screen 150 is supported by table 122, and one edge of the screen is aligned between jaws 126 and 128 of mold 124. Specifically, peripheral flattened wire(s) 18 are positioned between the jaws of the mold. Carriage 130 includes extruder 132, which has nozzle 134. Carriage 130 is moveable down track 136 in the x-direction, parallel to the longitudinal direction of the flattened wires. In the illustrated embodiment, carriage 130 is supplied with material from a hopper or storage container via hoses 138. Unlike mold 30, mold 124 is stationary in the shown embodiment, since only a single lap needs to be made on each screen's open edge (and many times double laps occur), the screen does not need to be readjusted several times with respect to apparatus 120. Extruder 132 substantially resembles extruder 34, except that nozzle 134 is bent at an angle so that nozzle 134 can extrude a bead between the jaws of the mold, and therefore the mold can remain stationary. It should be appreciated that if a stationary mold were desired for apparatus 20, a similarly bent nozzle could be included on extruder 32.

Once the peripheral flattened wires are aligned between the jaws of the mold, the extruder applies a bead along the x-direction over the edge of the screen, and the mold is closed on the bead for forming lap 17. This apparatus may also be controlled electronically by a computerized control unit.

It should be appreciated that variations on the above provided apparatus could be made and are within the scope of the current invention. For example, a pin block could be included adjacent to a clamp or in addition to a secondary clamp. Effectively, such an apparatus would perform substantially similar to the above described apparatus. It should also be generally appreciated that the mold could include a cavity having substantially any shape as desired for the shape of the support member, although the support member is preferably in the shape of the rectangular support strip or lap, as shown and described herein. In addition to individual controls, the process may be completely automated so that once the flattened wires are arranged in place, the activation of a single button, lever, switch, or the like, could trigger the apparatus to run through at least one complete cycle for forming at least one support strip.

The above-identified molten material or any first polymeric support member is not a pre-fabricated strip of any kind applied to any portion of the plurality of flattened wires. Otherwise, the above-identified desired results of the present invention are not maximized since the pre-fabricated strips, even if portions are partially melted, do not truly homogeneous encase, which the current invention is obtained the wires in order to obtain the desired results.

Figure 14:
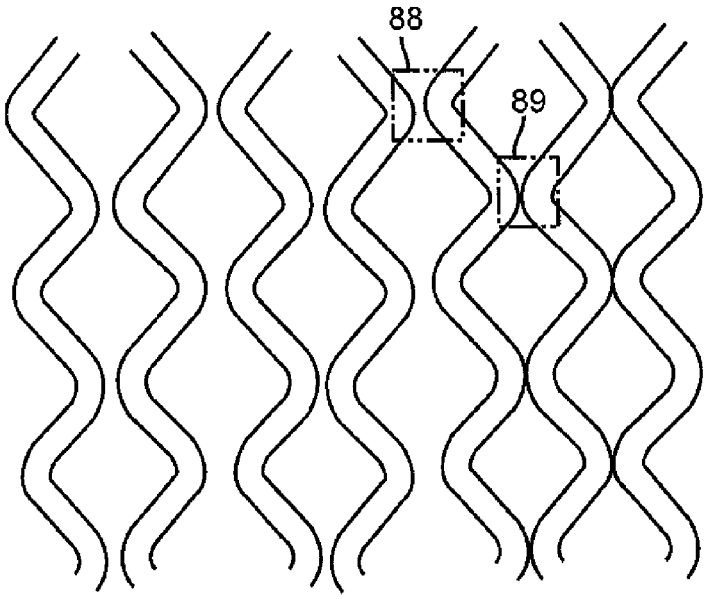
FIG. 14 is an image of the prior art device illustrating wide and narrow opening sizes in desired apertures with unacceptable tolerances that form when gaps positioned between warp wires prior to applying an overcoat that results in the warp wires migrating away and toward respective adjacent warp wires.

To illustrate the superiority of the claimed screen and method to manufacture the same over Hoyt's Serpa XLT screen, illustrated in FIG. 14, applicant has generated a chart that compares 9/16 inch screens of the claimed invention as manufactured by Buffalo Wire Works (identified as BWW) to Hoyt's screen. The results measured 48 distinct screen openings in relation to the standard industry tolerance as established by ASTM E2016-11, table 8, and determined the deviation for each measurement. The chart set forth below confirms that Hoyt's deviation was OUT of tolerance 46/48 times which is a rate of 96% being out of tolerance and those results are unacceptable—aka, only 4% was in tolerance—, while the instant invention's deviation was IN tolerance 48/48 times which means the instant invention was in tolerance 100%. This chart confirms the instant invention's product and method to manufacture the same generates desired results.

| Hoyt | | | BWW | |
|---|---|---|---|---|
| 0.532 | 0.517 | | 0.548 | 0.551 |
| 0.510 | 0.503 | | 0.542 | 0.544 |
| 0.518 | 0.523 | | 0.549 | 0.550 |
| 0.501 | 0.494 | | 0.545 | 0.548 |
| 0.498 | 0.503 | | 0.547 | 0.543 |
| 0.534 | 0.517 | | 0.549 | 0.543 |
| 0.510 | 0.521 | | 0.550 | 0.547 |
| 0.507 | 0.500 | | 0.548 | 0.544 |
| 0.496 | 0.521 | | 0.547 | 0.543 |
| 0.501 | 0.506 | | 0.545 | 0.545 |
| 0.510 | 0.502 | | 0.552 | 0.548 |
| 0.521 | 0.548 | | 0.551 | 0.546 |
| 0.499 | 0.523 | | 0.549 | 0.544 |
| 0.506 | 0.520 | | 0.552 | 0.546 |
| 0.528 | 0.592 | | 0.543 | 0.547 |
| 0.498 | 0.501 | | 0.552 | 0.548 |
| 0.492 | 0.518 | | 0.546 | 0.549 |
| 0.524 | 0.504 | | 0.545 | 0.550 |
| 0.507 | 0.536 | | 0.547 | 0.543 |
| 0.522 | 0.497 | | 0.547 | 0.548 |
| 0.504 | 0.591 | | 0.547 | 0.549 |
| 0.557 | 0.512 | | 0.542 | 0.544 |
| 0.505 | 0.533 | | 0.549 | 0.543 |
| 0.510 | 0.502 | | 0.548 | 0.545 |
| | 0.516 | Average | 0.547 | |
| | 0.021 | Std Dev | 0.003 | |

| IN TOLERANCE HOYT | OUT OF TOLERANCE HOYT | IN TOLERANCE BWW | OUT OF TOLERANCE BWW |
|---|---|---|---|
| 2 | 46 | 48 | 0 |

| OUT OF TOLERANCE BWW % | OUT OF TOLERANCE HOYT % | IN TOLERANCE BWW % | IN TOLERANCE HOYT % |
|---|---|---|---|
| 0 | 96 | 100 | 4 |

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

The invention claimed is:

1. A screen comprising a plurality of flattened wires arranged longitudinally in a first direction only, and having a first flattened wire and a second flattened wire positioned in an alignment coordinator to maintain (a) a specific distance from each other for a desired spacing that does not appear to ever contact each other, and/or (b) contact or a second specific distance with each other at spaced intervals along the first and second flattened wires to form a polygonic spacing between the first flattened wire and the second flattened wire where the first and second flattened wires do not contact or appear to contact each other, to form a desired screen spacing;

a deviation from the desired screen spacing is equal to or less than the standard industry tolerance as established by ASTM E2016-11, table 8;

a first polymeric support member encasing a first limited selected portion of the plurality of flattened wires wherein the first polymeric support member is (a) transverse to the first direction and (b) applied onto the first limited selected portion of the plurality of flattened wires;

a second polymeric support member encasing a second limited selected portion of the plurality of flattened wires wherein the second polymeric support member and the first polymeric member are spaced apart, and wherein the second polymeric support member is transverse to the first direction; and there is no additional metal material in, within, or on the first or second polymeric support members, and the desired screen spacing having a standard industry tolerance is maintained even when the first and second polymeric support members are applied and cured.

2. The screen of claim 1 wherein the first flattened wire is crimped.

3. The screen of claim 2 wherein the second flattened wire is crimped.

4. The screen of claim 1 wherein the specific distance from each other for a desired spacing that does not appear to ever contact each other forms a herringbone pattern.

5. The screen of claim 1 wherein the specific distance from each other for a desired spacing that does not appear to ever contact each other forms a harp-style pattern.

6. The screen of claim 1 wherein the plurality of flattened wires create a double warp wire weave.

7. The screen of claim 1 wherein the first and second polymeric support members comprise polyurethane.

8. The screen of claim 1 further comprising a lap.

9. The screen of claim 1 wherein the first polymeric support member is applied by an extrusion process.

10. The screen of claim 1 wherein the first polymeric support member is applied by melting the polymeric support member, and is not a pre-fabricated strip applied to the first limited selected portion of the plurality of flattened wires.

11. The screen of claim 1 wherein the deviation from the desired screen spacing is equal to or less than the standard industry tolerance as established by ASTM E2016-11, table 8 is about ±3%.

12. A method of making a screen of claim 1, said method comprising:

(a) longitudinally aligning said plurality of flattened wires in a first direction only and arranging said first and second flattened wires in a patterned configuration in an alignment coordinator to maintain (a) a specific distance from each other for a desired spacing that does not appear to ever contact each other, and/or (b) contact or a second specific distance with each other at spaced intervals along the first and second flattened wires to form a polygonic spacing between the first flattened wire and the second flattened wire where the first and second flattened wires do not contact or appear to contact each other, to form a desired screen spacing;

a deviation from the desired screen spacing is equal to or less than the standard industry tolerance as established by ASTM E2016-11, table 8;

(b) applying a first polymeric support member to encase a first limited selected portion of the plurality of flattened wires wherein the first polymeric support member is (a) transverse to the first direction and (b) applied onto and encasing the first limited selected portion of the plurality of flattened wires;

(c) applying a polymeric support member on said flattened wires (i) along a second path from the first edge of the screen to the second edge of the screen in the second direction transverse to the first direction and (ii) spaced a distance from the first polymeric support member, and directly applied onto and encasing the second limited selected portion of the plurality of flattened wires;

there is no additional metal material in, within, or on the first or second polymeric support members, and the desired screen spacing having a standard industry tolerance is maintained even when the first and second polymeric support members are applied and cured.

13. The method of claim 12 wherein said first and second support members are each a support strip for fixing said flattened wires in said patterned configuration and maintaining a vibration force.

14. The method of claim 12 wherein said first or second bead is applied on said flattened wires along a path defined in said first direction, wherein said support member is a lap for said flattened wire screen, and wherein said lap at least partially encases at least one peripheral flattened wire in said plurality of flattened wires.

15. The method of claim 12 wherein the first flattened wire is crimped.

16. The method of claim 15 wherein the second flattened wire is crimped.

17. The method of claim 12 wherein the specific distance from each other for a desired spacing that does not appear to ever contact each other forms a herringbone pattern.

18. The method of claim 12 wherein the specific distance from each other for a desired spacing that does not appear to ever contact each other forms a harp-style pattern.

19. The method of claim 12 wherein the plurality of flattened wires create a double warp wire weave.

20. The method of claim 12 wherein the polymeric material is a molten material that is not a pre-fabricated strip applied to the first limited selected portion of the plurality of flattened wires.

21. The method of claim 12 wherein the deviation from the desired screen spacing is equal to or less than the standard industry tolerance as established by ASTM E2016-11, table 8 is about ±3%.

* * * * *